United States Patent [19]

Uemura et al.

[11] 4,318,360

[45] Mar. 9, 1982

[54] CLOTH FEEDER FOR SEWING MACHINE

[75] Inventors: Tamio Uemura, Kawasaki; Yoshimasa Ito, Yokohama; Junichi Ikeda, Tokyo, all of Japan

[73] Assignee: Tokico, Ltd., Kanagawa, Japan

[21] Appl. No.: 151,665

[22] Filed: May 20, 1980

Related U.S. Application Data

[63] Continuation-in-part of Ser. No. 968,519, Dec. 11, 1978, abandoned.

[30] Foreign Application Priority Data

Dec. 15, 1977 [JP] Japan ..... 52-150932

[51] Int. Cl.[3] ..... D05B 27/14

[52] U.S. Cl. ..... 112/318; 112/275

[58] Field of Search ..... 112/318, 319, 322, 275, 112/277, 303

[56] References Cited

U.S. PATENT DOCUMENTS

| | | | |
|---|---|---|---|
| 3,747,827 | 7/1973 | Stanton et al. | 112/322 X |
| 3,783,805 | 1/1974 | Guichard | 112/322 X |
| 4,085,692 | 4/1978 | Soeda et al. | 112/275 |
| 4,147,120 | 4/1979 | Adamski, Jr. et al. | 112/318 |
| 4,248,170 | 2/1981 | Adamski, Jr. et al. | 112/318 |

*Primary Examiner*—H. Hampton Hunter

*Attorney, Agent, or Firm*—Wegner & Bretschneider

[57] ABSTRACT

A cloth feeder for sewing machine comprises a reciprocatively movable needle arranged so as to sew the cloth on the bed, a pulse generator for generating the electric pulses in order to feed the cloth during the needle stays away from the cloth, a step motor actuated by the pulses from the pulse generator, and a rotator driven by the step motor and arranged in pressed contact with the cloth so as to feed it.

13 Claims, 20 Drawing Figures

21a
33b
33d
32
31
33
33c
33a
34
GATE
35
OSCILLATOR
38
36
20a
COUNTER
PULSE GENERATOR
GATE
37
2
STEP MOTOR
7
8
9
10
12
5
13
14
15
11
1
18
18
17
16
6

21a
32
33
31
33b'
33d'
33c'
33a'
34
GATE
35
OSCILLATOR
38'
36
COUNTER
20a
PULSE
GENERATOR
37
GATE
2
5
7
8
9
10
12
13
STEP MOTOR
14
15
11
1
18
18
17
6
16

CLOTH FEEDER FOR SEWING MACHINE

CROSS-REFERENCE TO RELATED APPLICATION

The present application is a continuation-in-part of application Ser. No. 968,519, filed Dec. 11, 1978, and entitled "CLOTH FEEDER FOR SEWING MACHINE", now abandoned.

DETAILED DESCRIPTION OF THE INVENTION

This invention relates to the improvements in the cloth feeder adapted for use in the sewing machines and the like.

Generally, a cloth feeder mechanism for feeding the cloth in synchronized relation with the up and down movement of the needle is provided in the sewing machines, and such cloth feeder mechanism is an essential element irrespective of the type of the sewing machine, either for industrial use or for home use.

In the sewing machines for home use, the cloth feed rate by the cloth feeder may be low because the up and down moving speed of the sewing needle is low, but in the case of the sewing machines for industrial use, the moving speed of the needle is excessively high as compared with the sewing machines for home use and hence a specific cloth feeder mechanism is required.

However, in such specific cloth feeder mechanisms of the conventional type, the rotation of the needle driving spindle is first reduced in speed by reduction gearing and then converted into a rocking motion by a crank mechanism, and such rocking motion is again converted into an intermittent rotary motion by using a one-way clutch to thereby rotate the cloth feeding rollers when the up and down moving speed of the needle is elevated to a very high level, the cloth feeding rollers might fail to make the normal intermittent rotary motion and would instead make a continuous motion owing to the inertia of the one-way clutch or the cloth feeding rollers themselves, and as a result, the cloth might be fed while the needle is sticking into the cloth, causing break of the needle or other difficulties.

Also, in the conventional devices, because the cloth feeding rollers make an intermittent motion, extra load is exerted to the one-way clutch and/or other elements owing to the inertia of the cloth feeding rollers, etc., particularly when the operating speed is high, resulting in a short maintenance period of the cloth feeder mechanism.

An object of this invention is to provide a cloth feeder which is capable of producing an accurate intermittent rotary motion even during the high-speed cloth transfer to allow always correct amount of feed of the cloth and to thereby minimize trouble such as needle break in the cloth feeding operation.

Another object of this invention is to provide a cloth feeder which is capable of reducing phenomena such as so-called slippage puckering and seam puckering and of manufacturing sewed products with a high quality.

Another object of this invention is to provide a cloth feeder which is improved in durability and prolonged in the maintenance period.

Still another object of this invention is to provide a cloth feeder which can be adapted in combination with a mechanical cloth feeder device used in the sewing machines for domestic use and allows high-speed cloth feed in cooperation with such mechanical cloth feeder device.

Yet another object of this invention is to provide a cloth feeder which can be structured with almost entirely electronical arrangement to realize high-speed response.

A further object of this invention is to provide a cloth feeder mechanism which allows cloth feed synchronously with the up and down movement of the needle.

Still another object of this invention is to provide a cloth feeder which allows variable setting of the amount of cloth feed in one reciprocation of the needle.

An additional object of this invention is to provide a cloth feeder which allows variable setting of the cloth feed timing in one reciprocation of the needle.

Thus, according to this invention, there is provided a cloth feeder comprising a reciprocatively movable needle arranged so as to sew the cloth on the bed, a pulse generator which generates the electric pulses in order to feed the said cloth while said needle stays away from the cloth, a step motor actuated by the pulses from said pulse generator, and a rotator driven by said step motor and arranged in pressed contact with the cloth so as to feed it.

According to an embodiment of this invention, the pulse generator is adapted to generate pulses corresponding to the amount of the cloth to be fed only while the needle stays away from the cloth, or to generate pulses corresponding to the amount of the cloth to be fed as well as pulses for giving an elongation to the cloth in order to elongate the cloth even after the needle sticks into the cloth.

In a preferred embodiment of this invention, the pulse generator is composed of a needle position sensor and a drive pulse generator which generates a pulse signal based on the electric pulses from said needle position sensor, said sensor being adapted to detect the rotation of the spindle of the sewing machine, and in an embodiment the sensor is adapted to generate pulses after the needle sticks into the cloth.

According to another embodiment of this invention, the needle position sensor is constituted from a rotary disc secured to the sewing machine spindle and rotation detecting means which detects the amount of rotation of the said rotary disc.

According to still another embodiment of this invention, the drive pulse generator is constituted from an oscillator capable of generating the pulses successively and a gate means adapted to control issuance of the pulses from said oscillator to the step motor by a signal from the needle position sensor. Said gate means comprises the first and second gate circuits and a counter, said first circuit controlling issuance of the pulses from the oscillator to the counter by a signal from the needle position sensor, said counter counting the pulses from the first gate circuit, and said second gate circuit controlling issuance of the pulses from the oscillator to the step motor by a signal from said counter.

The present invention is now described in detail by way of some preferred embodiments thereof with reference to the accompanying drawings, whereby the above-said and other objects and features of this invention will be more apparently understood.

Figure 2:
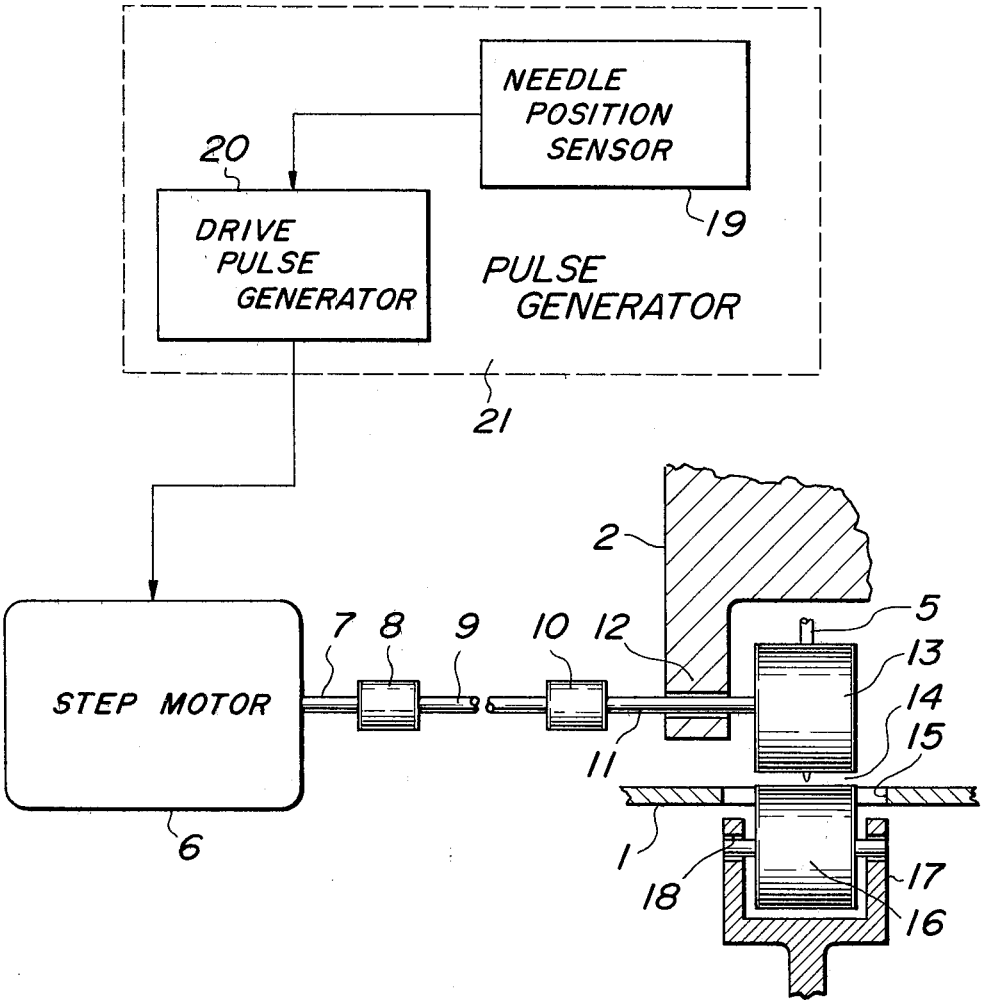
FIG. 2 is a schematic illustration of an embodiment of the cloth feeder according to this invention.
Figure 3:
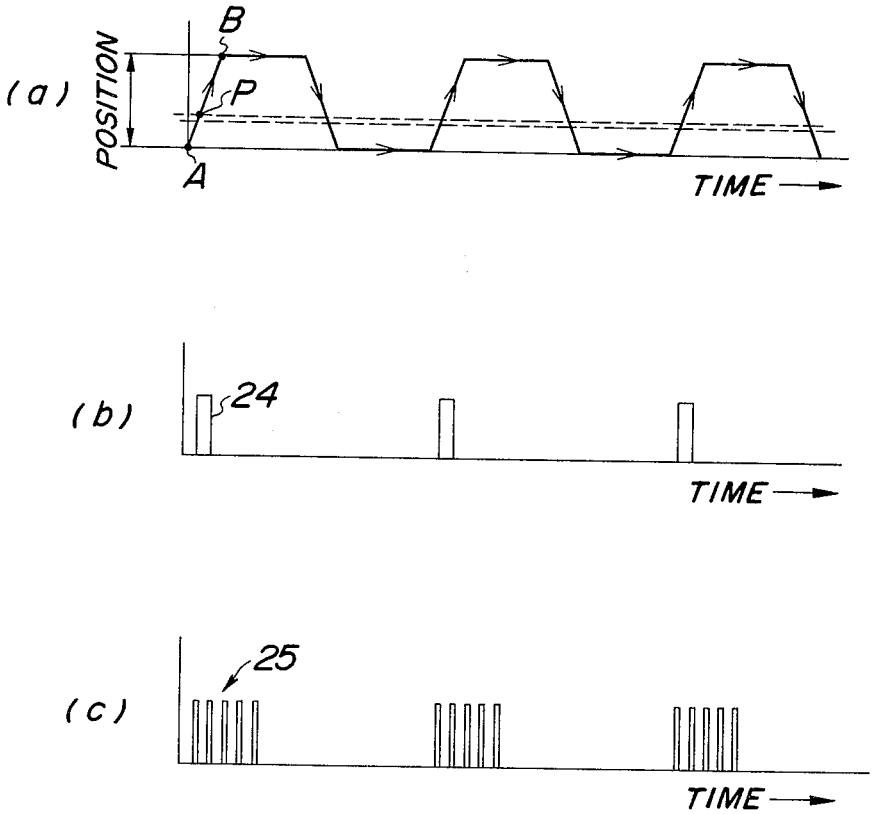
Figure 4:
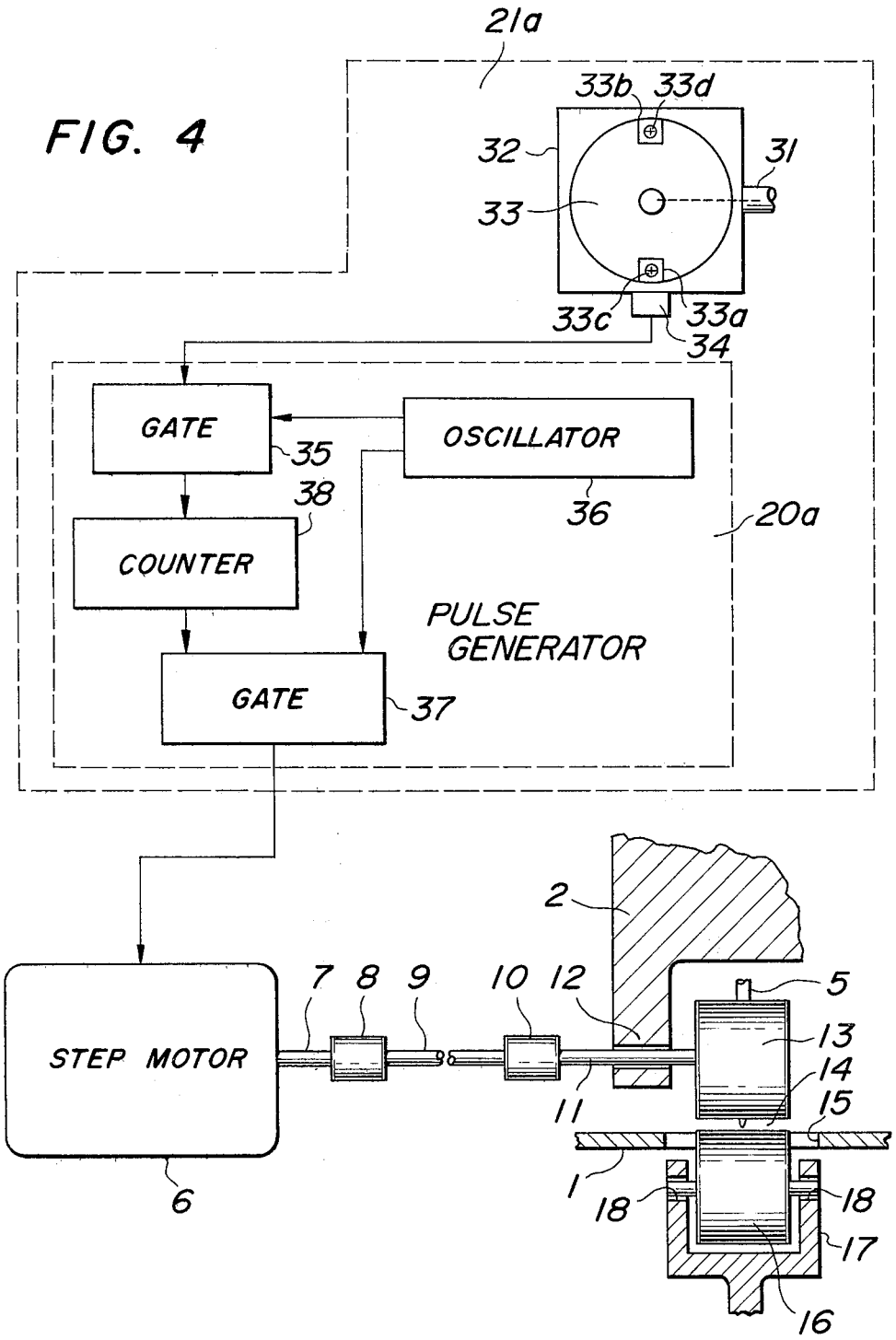

FIGS. 3(*a*) to (*c*) are waveform diagrams for illustrating the operation of the cloth feeder shown in FIG. 2, wherein (a) shows the needle position varying with time, (b) shows the relation of the output pulse from the needle position sensor with time, and (c) shows the relation of the output pulses from the drive pulse generator with time;

FIG. 4 is a schematic illustration of another embodiment of the cloth feeder according to this invention.

Figure 5:
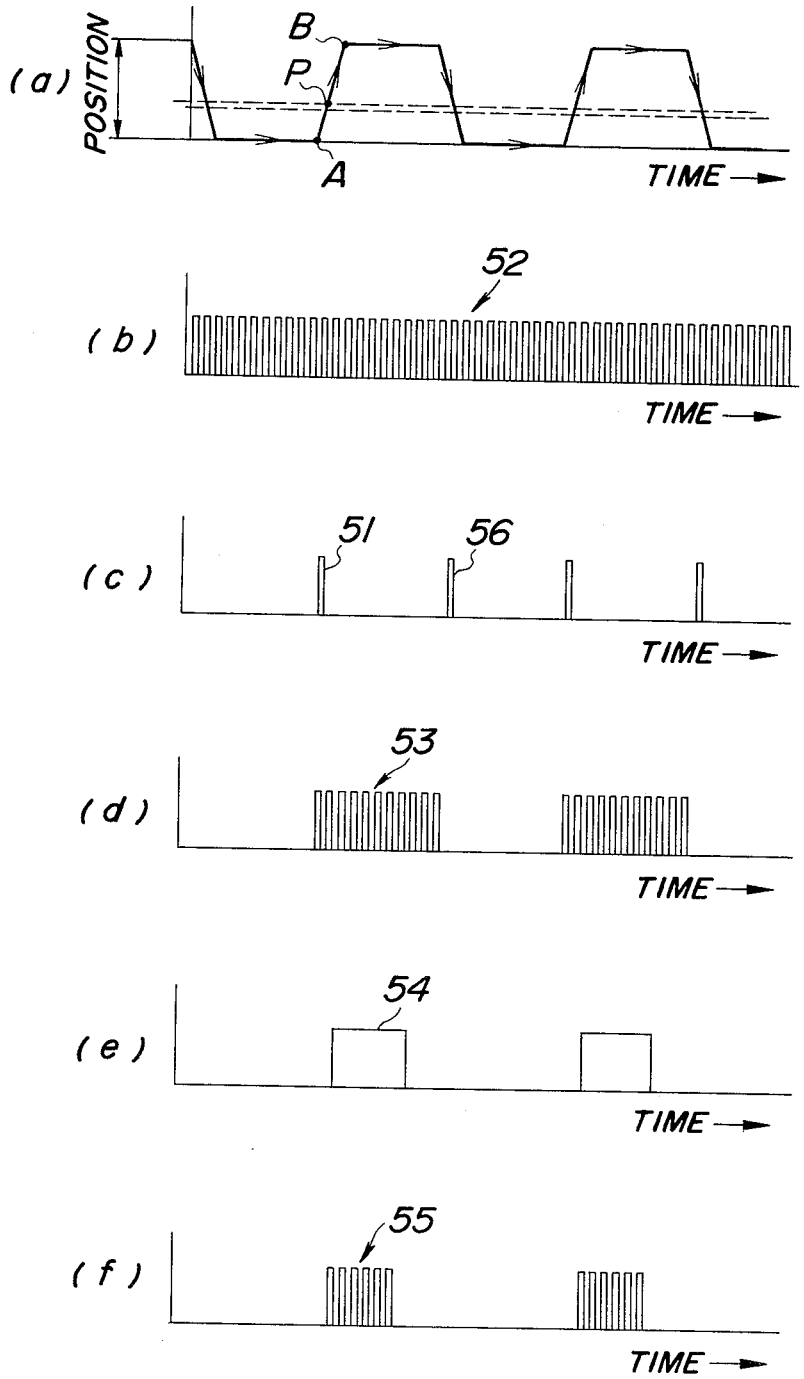
Figure 6:
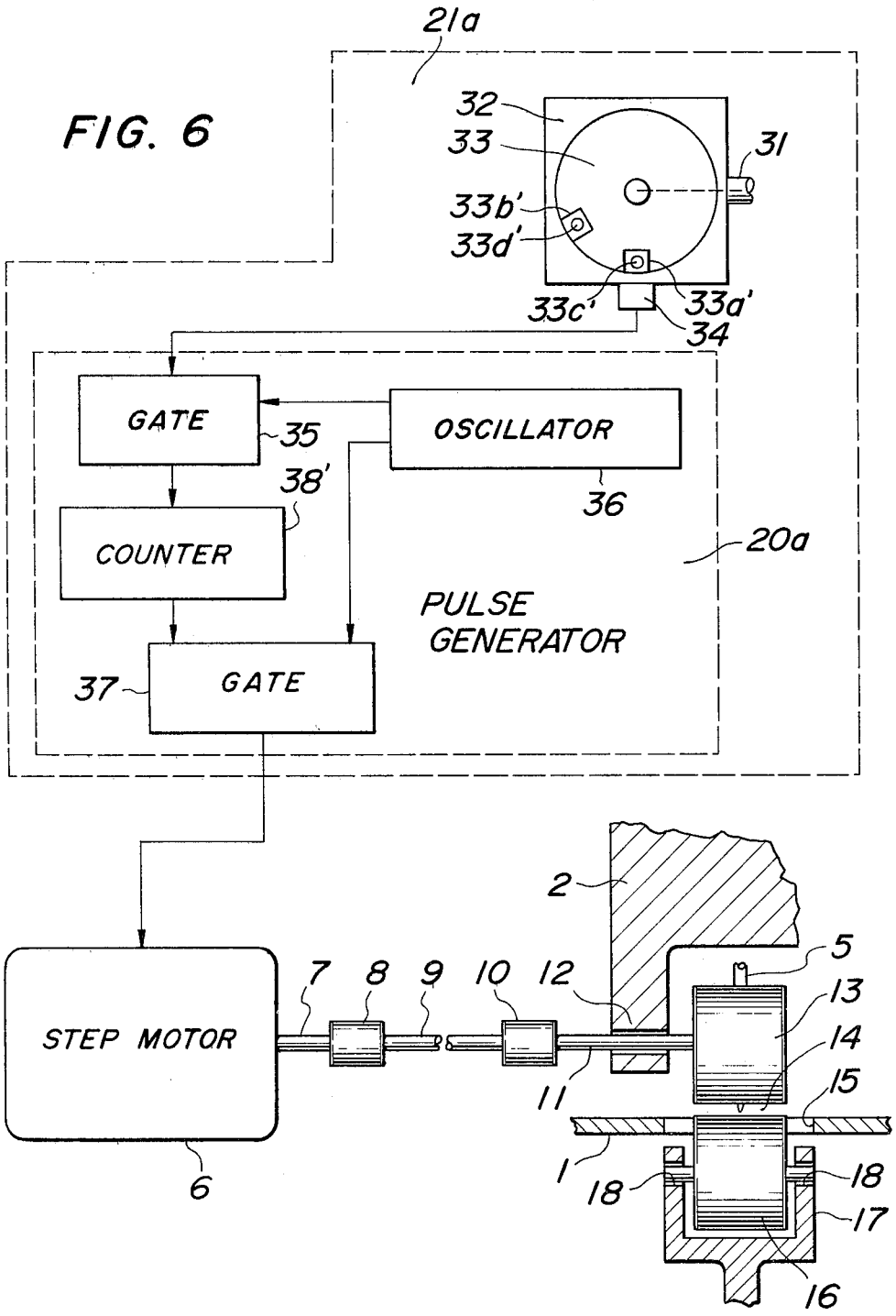
Figure 7:
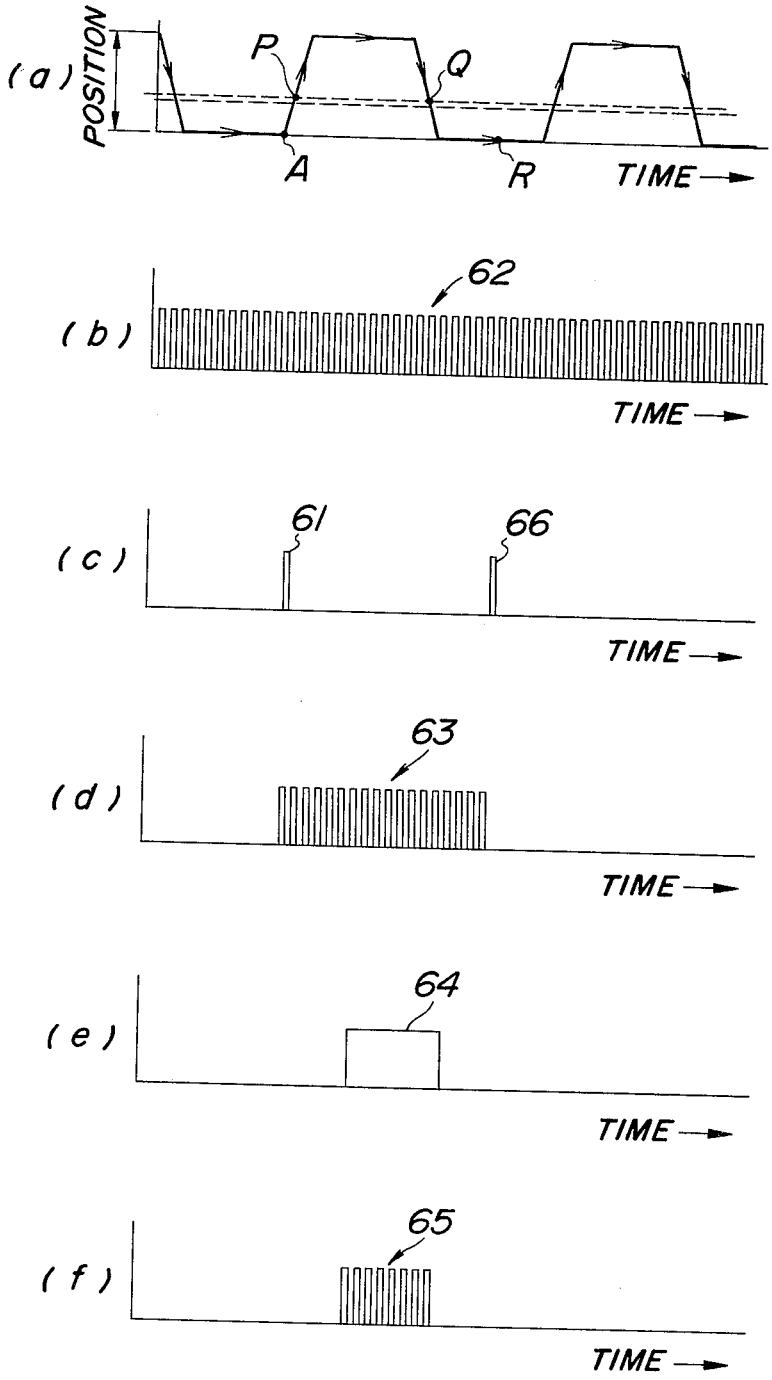
Figure 8:
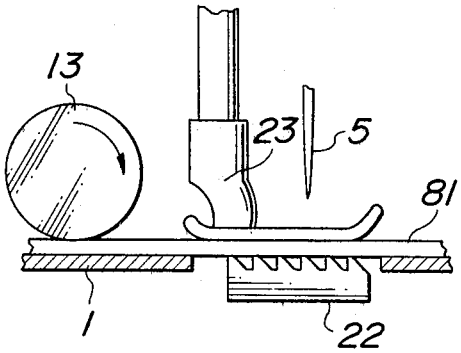

FIGS. 5(*a*) to (*f*) are waveform diagrams for illustrating the operation of the cloth feeder shown in FIG. 4 with relation to time, wherein (a) shows the needle position, (b) shows the output pulses from the oscillator, (c) shows the output pulses from the needle position sensor, (d) shows the output pulses from the first gate circuit, (e) shows the output pulse from the counter, and (f) shows the output pulses from the second gate circuit;

FIG. 6 is a schematic illustration of still another embodiment of the cloth feeder according to this invention;

FIGS. 7(*a*) to (*f*) are waveform diagrams for illustrating operation of the cloth feeder shown in FIG. 6 with relation to time, wherein (a) shows the needle position, (b) shows the output pulses from the oscillator, (c) shows the output pulses from the needle position sensor, (d) shows the output pulses from the first gate circuit, (e) shows the output pulses from the counter, and (f) shows the output pulses from the second gate circuit;

FIG. 8 is a sectional view of still another embodiment of the cloth feeder according to this invention.

Figure 1:
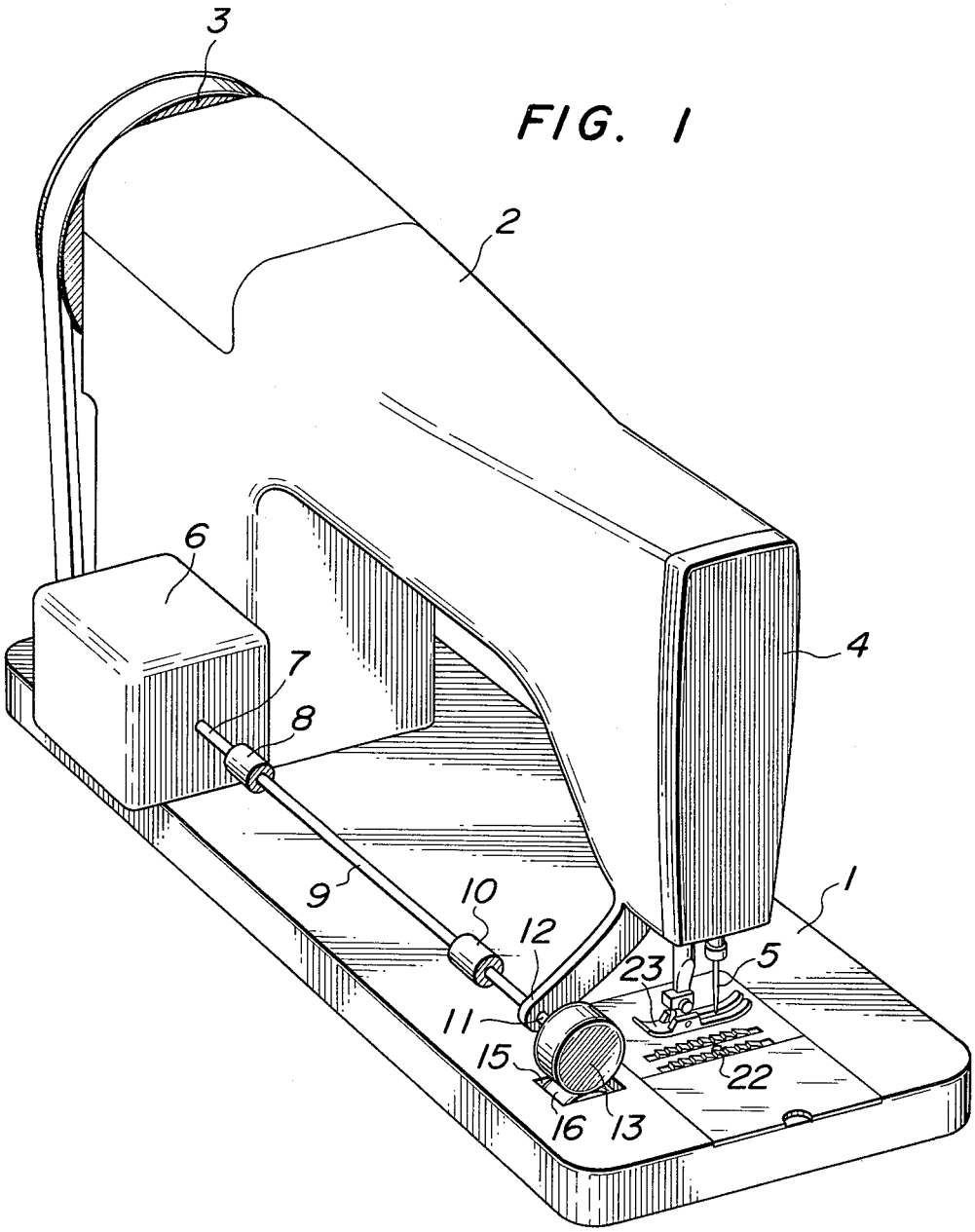
FIG. 1 is a perspective view of a sewing machine in which the cloth feeder according to this invention is adapted.

Referring first to FIGS. 1 to 3, the sewing machine body 2 is mounted on a bed 1. Provided below said bed 1 is a needle driving motor (not shown) of which the rotative force is transmitted to a pulley 3 to rotate the spindle (not shown in this embodiment). Provided in the sewing machine body 2 is a conversion mechanism 4 (the details thereof being not shown) for converting the rotation of the spindle rotated by said pulley 3 into a linear reciprocative motion to move up and down the needle 5.

A step motor 6 is provided at a side of said sewing machine body 2 and secured thereto. Extending out from said step motor 6 is the output shaft 7 to which a rod 9 is joined through a universal joint 8, said rod 9 being further joined to a shaft 11 through a universal joint 10.

The shaft 11 is supported in position below the sewing machine body 2 by a bearing 12 provided integral with said body 2. Mounted on said shaft 11 is a roller 13 (rotator) disposed in close adjacency to the bed 1 so as to form a space 14 allowing passage of a cloth (not shown) between said roller 13 and the bed 1. The needle 5 is provided adjacent to said roller 13 such that said needle 5 is positioned substantially at the middle point of the axis of said roller 13 when they are viewed from the front side of FIG. 1.

A hole 15 is provided at the position of the bed 1 corresponding to said roller 13, and a presser roller 16 is snugly fitted in said hole 15. This presser roller 16 is adapted to press the cloth in cooperation with the roller 13. It will be seen that said presser roller 16 is pivotally supported by a bearer 17 which is formed with holes 18, 18 for rotatably supporting the shaft of said roller 16.

The position of the needle 5 is always detected by a needle position sensor 19. In this embodiment, said needle position sensor 19 is designed to supply a predetermined electric signal to a drive pulse generator 20 when the needle 5 has left the cloth. Said needle position sensor 19 is arranged to photo-electrically or electromagnetically detect the position of the needle 5 either by detecting the position of the vertical shaft (not shown) on which the needle 5 is mounted, or by detecting the rotating position of the shaft (sewing machine spindle) which is joined to the pulley 3 for driving the needle 5.

For setting the device such that a signal will be issued when the needle 5 has come out of the cloth, the operator first raises the needle 5 manually and sets the needle position sensor 19 such that a signal will be given when the needle is away from the cloth. The drive pulse generator 20 supplies an electric pulse signal of a predetermined pulse number to said pulse motor 6 upon receiving an output signal from said needle position sensor 19. Since the rotation of the output shaft 7 of the pulse motor 6 per one pulse is predetermined, the number of rotations of the output shaft 7 are decided by the number of the pulses supplied to the pulse motor 6. In other words, the amount of feed of the cloth per one pulse is predetermined, so that the cloth held between the roller 13 and the presser roller 16 is fed by a predetermined amount according to the number of the pulses from the drive pulse generator 20. Thus, said needle position sensor 19 and drive pulse generator 20 constitute a pulse generator unit 21 which generates the pulses of a number corresponding to the amount of cloth to be fed while the needle 5 stays away from the cloth. On the bed 1 is provided a feed dog 22 servable as a mechanical cloth feeder in the sewing machines for home use, and the cloth held between said feed dog 22 and the presser bar 23 is transferred to the downstream side, that is, to the roller 13 side.

Now, the operation of the above-described embodiment of this invention is described.

In the vertical movement of the needle 5 from the lower dead point A to the upper dead point B, the needle 5 gets away from the cloth at the point P (see FIG. 3(*a*)). The needle position sensor 19 senses the needle arrival at this point and issues a pulse 24 (see FIG. 3(*b*)) to the drive pulse generator 20, whereupon the drive pulse generator 20 supplies a pulse or pulses 25 corresponding to one stitching pitch to the pulse motor 6 to drive it (5 pulses in FIG. 3(*c*)). The rotational displacement of the output shaft 7 of the pulse motor 6 is transmitted to the roller 13 through the universal joint 8, rod 9, universal joint 10 and shaft 11 to rotate the roller 13. The cloth held between said roller 13 and the presser roller 16 is fed by a predetermined amount by the rotation of said roller 13. Needless to say, the feeding of the cloth by means of the feed dog 22 is performed synchronously with the feeding of the cloth by the roller 13. Generally, it is required that the pulse motor 6 is capable of properly rotating the shaft 11 according to the pulses from the drive pulse generator 20 within the period of time when the needle stays away from the cloth. This requirement can be easily met by using a pulse motor with high responsiveness.

Referring now to FIGS. 4 and 5, there is shown another embodiment of this invention, and as noted, the elements same as those used in the foregoing embodiment are assigned the corresponding reference numerals.

The rotation of the motor which drives the needle 5 is transmitted to a rotary disc 33 in the needle position sensor 32 mounted on the spindle 31. The mechanical arrangement is made such that one rotation of the rotary disc 33 corresponds to one reciprocation of the needle 5. Said rotary disc 33 is provided with, for example, two permanent magnets 33*a*, 33*b* which are so arranged as to be movable along the circumference of the disc 33 when their fixing screws 33*c*, 33*d* are loosened. A magnetic diode 34 is provided, for example, on the lower side of the rotary disc 33 so as to supply a pulse signal to a gate circuit 35, described below, when for example the permanent magnet 33*a* is positioned in alignment with the magnetic diode 34. Said gate circuit 35 is arranged such that the gate is opened by the pulse signal when the permanent magnet 33*a* is positioned in alignement with the magnetic diode 34 and the gate is closed when the permanent magnet 33*b* is positioned in alignment with the magnetic diode 34.

There is also provided an oscillator 36 which continuously supplies a plurality of pulses to the gate circuit 35 and another gate circuit 37 described below. Thus, the pulses from the oscillator 36 are given through the gate circuit 35 to the counter 38 from the time when the permanent magnet 33*a* of the rotary disc 33 is positioned in alignment with the magnetic diode 34 till another permanent magnet 33*b* comes to the position of the magnetic diode 34. The counter 38 is designed to count the pulses from the gate circuit 35 and supplies a signal to the gate circuit 37 when said counted pulses have amounted to a first set number, and it further continues to count the pulses and breaks off signal output when the pulses have amounted to a second set number. Therefore, it is possible to set as desired the time point at which the pulse motor 6 is operated while the needle 5 is away from the cloth by properly selecting the first set number and the second set number of the counter 38. The counter 38 is reset automatically when the pulses from the gate circuit 35 are shut off.

Thus, in this embodiment, said gate circuits 35, 37, oscillator 36 and counter 38 constitute the drive pulse generator unit 20*a*, and the gate circuits 35, 37, oscillator 36, counter 38 and needle position sensor 32 constitute the pulse generator unit 21*a*.

Now, the operation of the just described embodiment of this invention is discussed.

In the vertical movement of the needle from its lower dead point A to the upper dead point B, when the needle 5 reaches the position P (see FIG. 5(*a*)) where the needle has just emerged from the upper surface of the cloth, the permanent magnet 33*a* is positioned in alignment with the magnetic diode 34 and a pulse signal 51 (see FIG. 5(*c*)) indicating separation of the needle 5 from the cloth is supplied from the magnetic diode 34 to the gate circuit 55, whereupon the gate of the gate circuit 35 is opened and the pulses 52 (see FIG. 5(*b*)) from the oscillator 36 are supplied to the counter 38 in the form of pulse groups 53 such as shown in FIG. 5(*d*)), and at the same time the counter 38 starts to count the pulses 53. During this operation, the rotary disc 33 keeps rotating. When the pulses supplied to the counter 38 reach a certain set number, that is, when for example the 3rd pulse in the group of pulses 53 shown in FIG. 5(*d*) is supplied to the counter 38 (this corresponds to the first set number), the counter 38 supplies a gate signal 54 (see FIG. 5(*e*)) to the second gate circuit 37. The gate circuit 37, which receives the pulses 52 from the oscillator 36 and the gate signal 54 from the counter 38, gates the pulses 52 from the oscillator 36 upon receiving the gate signal 54 and supplies the pulses 55 (see FIG. 5(*f*)) to the step motor 6. The step motor 6 is actuated upon receiving the pulses from the gate circuit 37, and accordingly the output shaft 7 of said motor 6 is rotated and its rotation is transmitted to the roller 13 to let it turn to thereby feed the cloth. During this cloth feed, the counter 38 counts the pulses 53 successively, and when the counted value reaches a certain set number, that is when for example the 9th pulse is counted by the counter 38 (this corresponds to the second set number), the counter 38 breaks off output of the gate signal 54, whereby issuance of the pulse 52 from the gate circuit 37 is interrupted and no pulse is supplied to the pulse motor 6, so that the pulse motor 6 ceases its rotation and accordingly feed of the cloth is stopped. When the rotary disc 33 further turns and the permanent magnet 33*b* comes to the position corresponding to the magnetic diode 34, a pulse 56 is produced from the magnetic diode 34, whereupon the gate of the gate circuit 35 is closed and at the same time the counter 38 is reset. Cloth feed by the feed dog is also performed synchronously with cloth feed by the roller 13. The above-said operation is repeated when the needle 5 descends to stick into the cloth and again moves away therefrom.

FIG. 6 and FIG. 7 show other embodiments of this invention, and the same identification numbers as those of above-mentioned embodiments are given to the components which are the same as those of above-mentioned embodiments.

In sewing a cloth, elongation of a thread is generally larger than that of a cloth, so seam puckering of a cloth-shrinkage after sewing is brought about. But if elongation of a thread is equal to that of a cloth, above phenomenon will not occur. The embodiments of this invention relate to the cloth feeder which is free from seam puckering.

On a rotary disc 33, two permanent magnets 33*a*′, 33*b*′ are fixed by fixing screws 33*c*′, 33*d*′. The fixed position of the permanent magnet 33*a*′ is just the same as that of the aforementioned embodiment where a needle 5 stays away from a cloth. The fixed position of the permanent magnet 33*b*′ is the lower dead point of the needle 5.

A counter 38′ is different from that of above-mentioned embodiment in that the first and second set numbers are different. Namely if the amount of the cloth to be fed is equal to that of said embodiment, a cloth is fed before or after the needle sticks the cloth.

This is because a small amount of the conveying force is applied to the cloth after the needle 5 sticks into the cloth, which results in forcing the cloth to stretch to the same elongation as the thread, in order to prevent seam puckering.

Now, the operation of the above-described embodiment of this invention is described.

In the vertical movement of the needle 5 from the lower dead point, said permanent magnet 33*a*′ reaches said magnetic diode 34 at the point P where the needle raised from the lower dead point sticks out from the surface of the cloth (see FIG. 7(*a*)). Whereby the magnetic diode 34 issues a pulse signal 61 to a gate circuit 35 shown in FIG. 7(*c*), which signal indicates that the needle 5 sticks out through the cloth. This signal opens a gate of the gate circuit 35, a pulse 62 from a pulse generator 36 shown in FIG. 7(*b*) is supplied to the counter 38′ in the form of pulse 63 shown in FIG. 7(*d*), and the counter 38′ begins counting the pulse 63. When the pulses 63 supplied to the counter 38′ reach a certain set number, that is, when for example the 7th pulse in the group of pulses 63 shown in FIG. 7(*d*) is supplied to the counter 38′ (this corresponds to the first set number), the counter 38' supplies a gate signal 64 (see FIG. 7(*e*)) to the second gate circuit 37. Whereby a step motor 6 receives the pulse 65 (see FIG. 7(*f*)) from the pulse generator 36 and the step motor 6 feeds the cloth. By the time when said needle 5 falls from the upper dead point and is about to penetrate the cloth, 6 pulses out of the pulse 65 are transmitted to the step motor 6 and corresponding to which, the cloth is fed. The needle 5 further keeps falling down and sticks the cloth at the position Q, but the second gate circuit 37 remains open after the needle 5 sticks the cloth. Whereby the pulses are further supplied to the step motor 6. Consequently the step motor 6 rotates to stretch the cloth because the needle 5 is constraining the cloth. After the needle 5 sticks the cloth, when 2 pulses are further supplied to the counter 38', that is, for example when the counter 38' counts the 14th pulse (this corresponds to the second set number), the counter 38' stops issuance of the gate signal 64. Thus, issuance of the pulses 62 from the gate circuit 37 is interrupted and no pulse is supplied to the pulse motor 6, so that the pulse motor 6 ceases its rotation and accordingly feed of the cloth is stopped. And when the rotary disc 33 turns and the permanent magnet **33*b'* comes to meet with the magnetic diode 34 at the position R, a pulse 66 is produced from the magnetic diode 34, whereupon the gate of the gate circuit 35 is closed and at the same time the counter 38 is reset. Cloth feed by the feed dog is also performed synchronously with cloth feed by the roller 13. The above-mentioned operation is repeated when the needle 5** moves away from the cloth again.

Through the above-mentioned operation, the sewed cloth shrinks accompanying with the shrinkage of the string, however, the cloth is elongated in advance so that the said seam puckering phenomenon does not occur.

Any change of the amount of cloth feed can be effected by suitably changing the first and second set numbers of the counter 38.

In any of the above-described embodiments, the presser roller 16 may not necessarily be provided if the surface of the bed 1 is specular-finished. For instance, as shown in FIG. 8, the roller 13 may be disposed in close adjacency to the upper surface of the bed 1 so as to form a space allowing passage of the cloth 81 between the roller 13 and bed 1. In this case, roller 13 is adapted to press the cloth 81 in cooperation with the bed 1. Accordingly, the cloth 81 held between the roller 13 and the bed 1 is transferred glidingly on the upper surface of the bed 1 when the roller 13 is rotated.

Further, the needle position sensor 19, 32 may be of a lead switch type or a high frequency type, or may be so arranged as to directly detect the displacement of the needle 5.

What is claimed is:

1. A cloth feeder for use in combination with a sewing machine, said sewing machine having a body installed on a bed, a needle adapted for reciprocal motion coupled to a main driving shaft, and a feed dog for transferring a cloth on said bed, comprising;

(a) a step motor fitted to said body and having an output shaft rotated by a predetermined amount in accordance with each pulse of a plurality of electric pulse signals supplied during one reciprocal movement of said sewing needle;

(b) a rotator means rotatably supported on said bed by said body and coupled to said output shaft of said step motor to be rotated with the rotation of said output shaft, said rotator means clamping a cloth transferred by said feed dog and transferring the cloth in cooperation with said feed dog by the rotation thereof;

(c) a disc fixed to said main driving shaft, said disc rotating with the movement of said sewing needle;

(d) means for detecting the rotation of said disc and generating a position indicating signal comprising a plurality of pulses for identifying the position of said sewing needle during the reciprocal movement thereof; and (e) a driving pulse generator generating a plurality of electric pulse signals in accordance with the position indicating signal and supplying said electric pulse signals to said step motor;

whereby the feed amount of said cloth transferred by said rotator means during one reciprocal movement of said sewing needle is determined by the number of pulses generated by said driving pulse generator.

2. The cloth feeder according to claim 1, wherein said driving-pulse generator is provided with a counter for counting the number of pulses corresponding to the electric pulse signal so as to determine the number of said electric pulse signal to be supplied to said step motor during one reciprocal movement of said sewing needle and a first gate means which allows the supply of an electric pulse to said step motor in the case where the counted value in said counter becomes to the predetermined first value and inhibits said supply of electric pulse to said step motor in the case where the counted value in said counter becomes to the predetermined second value.

3. The cloth feeder according to claim 2, wherein said driving pulse generator is further provided with a second gate means which allows the supply of pulse signals to the counter when one pulse of the electric pulses which are generated by said detecting means during one reciprocal movement of said needle is supplied to said second gate means and prohibits the supply of pulse signals to said counter when another pulse of electric pulse signals is supplied to said second gate means, in the same time, resets the counted value of said counter.

4. The cloth feeder according to claim 3, wherein said detecting means is arranged to said disc so that one pulse which is to be supplied to said second gate means is generated from said detecting means during the time said sewing needle is out of said cloth.

5. The cloth feeder according to claim 4, wherein said detecting means is arranged to said disc so that another pulse which is to be supplied to said second gate means is generated from said detecting means during the time said sewing needle is out of said cloth.

6. The cloth feeder according to claim 4, wherein said detecting means is arranged to said disc so that another pulse which is to be supplied to said second gate means is generated from said detecting means after said sewing needle stuck in said cloth.

7. The cloth feeder according to claim 3, wherein the position of said detecting means is variably set so as to generate an electric pulse signal signifying an arbitrary position within one reciprocal movement of said sewing needle.

8. A cloth feeder for use in combination with a sewing machine, said sewing machine having a body installed on a bed, and a needle adapted for reciprocal motion coupled to a main driving shaft, comprising:

a step motor fitted to the body of said sewing machine having an output shaft which rotates by a predetermined amount in accordance with each pulse supplied by a signal having a plurality of electrical pulses supplied during movement of the sewing needle of said sewing machine;

a rotator rotatably supported on said bed by said sewing machine body and coupled to said output shaft, said rotator means cooperating with a presser roller for transferring a cloth held between said presser roller and rotator means;

a disc fixed to said main driving shaft of said sewing machine, said disc rotating with the movement of said sewing needle;

means for detecting the rotation of said disc and generating a position indicating signal comprising a plurality of pulses for identifying the position of said sewing needle during the reciprocal movement thereof; and a driving pulse generator generating a plurality of electrical pulse signals in accordance with the position indicating signal and supplying said electric pulse signals to said step motor whereby the cloth is transferred during the reciprocal movement of said sewing needle, the amount of cloth transferred being determined by the number of pulses produced by said driving pulse generator.

9. The cloth feeder according to claim 8, wherein said driving-pulse generator is provided with a counter counting the number of pulse produced by said position indicating signal so as to determine the number of electric pulses to be supplied to said step motor during one reciprocal movement of said sewing needle; and a first gate means which allows the supply of number of pulses becomes equal to a predetermined first value, and inhibits a supply of electric pulses to said step motor in the case where the counted value becomes equal to a predetermined second value.

10. The cloth feeder according to claim 9, wherein said driving pulse generator is provided with a second gate means which allows a supply of pulse signals to the counter when one pulse of the electric pulses which are generated by said detecting means during one reciprocal movement of said needle is supplied to said second gate means and prohibits the supply of pulse signals to said counter when another pulse of electric pulse signal is supplied to said second gate, and at the same time, resets the counted value of said counter.

11. The cloth feeder according to claim 10, wherein said detecting means is arranged to said disc so that one pulse which is to be supplied to said second gate means is generated from said detecting means during the time said sewing needle is out of said cloth.

12. The cloth feeder according to claim 11, wherein said detecting means is arranged to said disc so that a pulse which is to be supplied to said second gate means is generated from said detecting means after said sewing needle is stuck in said cloth.

13. The cloth feeder according to claim 10, wherein the position of said detecting means is variably set so as to generate an electric pulse signal signifying an arbitrary position within one reciprocal movement of said sewing needle.

* * * * *

UNITED STATES PATENT AND TRADEMARK OFFICE

CERTIFICATE OF CORRECTION

PATENT NO. : 4,318,360

DATED : March 9, 1982

INVENTOR(S) : Tamio UEMURA ET AL

It is certified that error appears in the above—identified patent and that said Letters Patent is hereby corrected as shown below:

On the title page, assignee should read:

--Tokyo Juki Industrial Co., Ltd., Tokyo, Japan--

Signed and Sealed this

*Third* Day of *August 1982*

[SEAL]

*Attest:*

GERALD J. MOSSINGHOFF

*Attesting Officer*

*Commissioner of Patents and Trademarks*